US008690249B2

(12) United States Patent
Kang et al.

(10) Patent No.: US 8,690,249 B2
(45) Date of Patent: Apr. 8, 2014

(54) CHAIR HAVING AN ADJUSTABLE BACKREST FOR SPINAL PROTECTION

(76) Inventors: Jig Won Kang, Daejeon (KR); Kyong Ja Choi, Daejeon (KR)

( * ) Notice: Subject to any disclaimer, the term of this patent is extended or adjusted under 35 U.S.C. 154(b) by 138 days.

(21) Appl. No.: 13/142,625

(22) PCT Filed: May 10, 2010

(86) PCT No.: PCT/KR2010/002946
§ 371 (c)(1),
(2), (4) Date: Jun. 29, 2011

(87) PCT Pub. No.: WO2011/016614
PCT Pub. Date: Feb. 10, 2011

(65) Prior Publication Data

US 2012/0146376 A1 Jun. 14, 2012

(30) Foreign Application Priority Data

Aug. 6, 2009 (KR) ..... 10-2009-0072207

(51) Int. Cl.
*B60N 2/22* (2006.01)

(52) U.S. Cl.
USPC ..... 297/353

(58) Field of Classification Search
USPC ..... 297/353
See application file for complete search history.

(56) References Cited

U.S. PATENT DOCUMENTS

| | | | | |
|---|---|---|---|---|
| 2,509,102 | A * | 5/1950 | Kuebler | 297/353 |
| 4,632,458 | A * | 12/1986 | Brown et al. | 297/353 |
| 5,405,189 | A * | 4/1995 | Stumpf | 297/353 |
| 5,586,809 | A | 12/1996 | Szmadzinski | |
| 6,419,318 | B1 * | 7/2002 | Albright | 297/284.7 |
| 6,533,355 | B2 * | 3/2003 | Broekhuis et al. | 297/353 |
| 6,540,296 | B1 * | 4/2003 | Shats et al. | 297/353 |
| 7,080,885 | B2 * | 7/2006 | Bain et al. | 297/354.1 |
| 8,020,934 | B2 * | 9/2011 | Hu | 297/353 |

FOREIGN PATENT DOCUMENTS

| | | |
|---|---|---|
| JP | 2008-012186 | 1/2008 |
| KR | 10-1999-0036089 | 5/1999 |
| KR | 20-0422529 | 7/2006 |
| KR | 10-0813215 | 3/2008 |

* cited by examiner

*Primary Examiner* — David R Dunn
*Assistant Examiner* — Timothy J Brindley
(74) *Attorney, Agent, or Firm* — Cantor Colburn LLP

(57) ABSTRACT

The present invention relates to a chair having an adjustable backrest for spinal protection in that an inside of a backrest structure is provided with an auxiliary backrest for protecting a lumbar vertebrae, and a rack and pinion structure is employed in the backrest and the auxiliary backrest in such a manner that the backrest slides vertically and the auxiliary backrest also slides vertically by the same ratio such that the backrest and the auxiliary backrest can be adjusted appropriately and used flexibly to match the sitting height of the person sitting on the seat, thereby making it possible to provide effective protection to the spinal joints of the waist, back and neck of the user.

4 Claims, 6 Drawing Sheets

< A-A' >

( 6a ) ( 6b )

CHAIR HAVING AN ADJUSTABLE BACKREST FOR SPINAL PROTECTION

TECHNICAL FIELD

The present invention relates to a chair having an adjustable backrest for spinal protection. More particularly, the present invention relates to a chair having an adjustable backrest for spinal protection in that a height of a backrest can be appropriately controlled in accordance with the sitting height of the person sitting on the chair, so that it can effectively support a cervical vertebra, a thoracic vertebra, and a lumbar vertebra thereof, whereby perfectly protect the back thereof.

BACKGROUND ART

Generally, a back of a human body is composed of a spinal joint of S-shape from a neck to a hip thereof. This is called as a backbone. The backbone includes a cervical vertebra, which is a neck part, a thoracic vertebra, which is a chest party, and a lumbar vertebra and a tailbone. Among them, the lumbar part is called as a waist. Here, the pain in the waist is called as a lumbar disc. Especially, the weight of the entire human body is applied the most on the waist in a mankind walling upright. Accordingly, a great number of people suffer from the lumbar disc.

In case of the lumbar disc, when he is bedridden, the pain is very weak owing to a small load. When he is standing, the pain is weak in the second place. In the meantime, when he is seated with his waist bent, the pain is most severe owing to a big load on the spine.

Accordingly, since it is forced to basically bring about the lumbar disc owing to the walking upright, a chair is one of the most convenient tools for human life.

The conventional chair 50, as shown in FIG. 6*a*, includes a seat plate part 51 for sitting thereon, a backrest 52 for supporting the waist, an armrest 53, and a chair leg 54. However, most of the conventional chair are provided with the backrest 53 for only simply support and protect the waist thereof during working and sitting on the chair. Since this conventional chair can concentrically support only the lumbar, it cannot protect a cervical vertebra or a thoracic vertebra etc.

In order to solve the above problem, as shown in FIG. 6*b*, besides the seat plate part 51 for sitting thereon, the backrest 52 for supporting the waist, the armrest 53, and the chair leg 54, an improved chair 60 including a thoracic support 55 and a cervical support 56 for sufficiently protect the thoracic vertebra and the cervical vertebra had been variously disclosed in shape and structure so as to effectively support the back portion and the neck portion.

However, in most of the conventional chairs 60, only the structures of the thoracic support 55 and the cervical support 56 thereof are variously and conveniently changed so as to protect only the thoracic vertebra and the cervical vertebra. That is, it cannot appropriately and flexibly cope with various sizes of the sitting height of the person sitting on the chair. In other words, where the persons having different sitting heights are sat on the same chair, it slows down the function capable of supporting and protecting the cervical vertebra or the thoracic vertebra etc. owing to the backrest that does not suit various body types. Hence, it can lead to waist health problems of the person working and sitting on the chair for a long time.

DISCLOSURE

Technical Problem

Therefore, the present invention has been made in view of the above-mentioned problems, and an object of the present invention is to provide a chair having an adjustable backrest for spinal protection in which an inside of a backrest structure is provided with an auxiliary backrest for protecting a lumbar vertebrae, and a rack and pinion structure is employed in the backrest and the auxiliary backrest in such a manner that the backrest slides vertically and the auxiliary backrest also slides vertically by the same ratio such that the backrest and the auxiliary backrest can be adjusted appropriately and used flexibly to match the sitting height of the person sitting on the seat, thereby making it possible to provide effective protection to the spinal joints of the waist, back and neck of the user.

Technical Solution

In accordance with an aspect of the present invention to achieve the objects thereof, there is provided a chair 10 having an adjustable backrest for spinal protection having a seat plate part 12 with a plurality of supporting legs 11 capable of sitting a user thereon, a cushion part 13 with a lumbar support (a), a thoracic support (b), and a cervical support (c) formed directly on back surface of the seat plate part and that supports and protects a spine including lumbar, thoracic, and cervical vertebras of a user at the back thereof, and a backrest 14 for fixing and supporting the cushion part 13 thereto comprising: a backrest height adjusting means 15 for elastically coupling the backrest 14 to the seat plate part 12 and adjusting the height of the backrest 14; a lumbar supporting plate 16 formed between the cushion part 13 and the backrest 14 and that supports flexibly the lumbar vertebra, whose position is changed according to sitting heights of the users; a rack and pinion means 18 connected and fixed to a fixing bracket 17, which is formed at an end portion of the backrest height adjusting means 15 and that allows the backrest 14 and lumbar supporting plate 16 to slides vertically so as to control flexibly the height thereof; and a backrest fixing guide bracket 19 formed at an lower end portion of the backrest 14 so as to fix the backrest 14 thereto and that inserts the backrest height adjusting means 15 therein so as to slide vertically the backrest height adjusting means 15.

Advantageous Effects

The chair having the adjustable backrest for spinal protection according to the present invention as described above has advantageous effects in that the rack and pinion structure is employed in the backrest and the auxiliary backrest in such a manner that the backrest slides vertically by means of the person sitting on the chair and the auxiliary backrest also slides vertically by the same ratio such that the backrest and the auxiliary backrest can be adjusted appropriately and used flexibly to match the sitting height of the person sitting on the seat, thereby making it possible to provide effective protection to the spinal joints of the waist, back and neck of the user. Also, since various users having different sitting heights can share one chair, it can manufacture in bulk and improve the productivity thereof, thereby increasing the utility and vitalizing industries thereof.

BRIEF DESCRIPTION OF THE DRAWINGS

The foregoing and other objects, features and advantages of the present invention will become more apparent from the following detailed description when taken in conjunction with the accompanying drawings in which.

Figure 1:
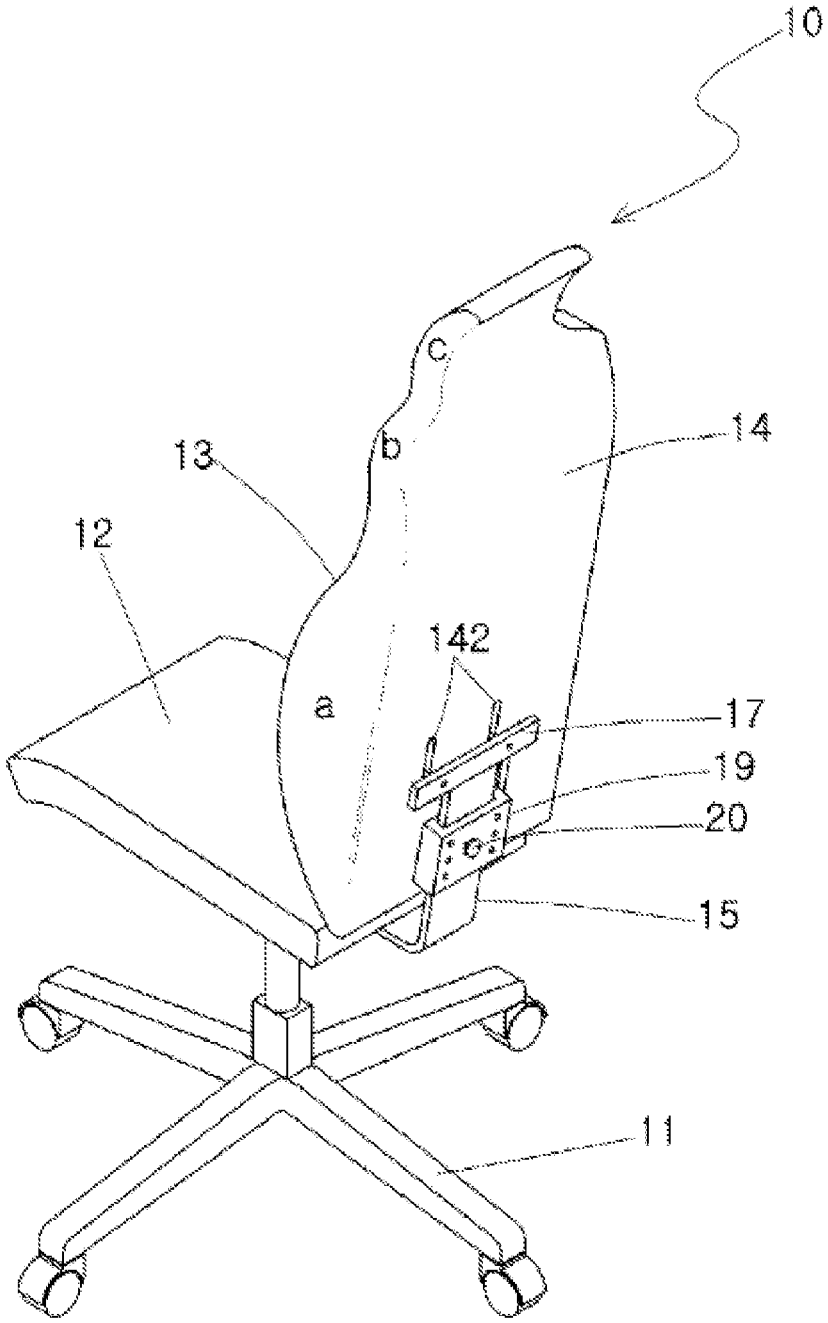
FIG. 1 is a perspective view illustrating a chair having an adjustable backrest for spinal protection according to the present invention.

<Descriptions on reference numbers for the major components in the drawings>

| | |
|---|---|
| 10: chair having adjustable backrest for spinal protection | |
| 11: supporting legs | 12: seat plate part |
| 13: cushion part | 14: backrest |
| 15: backrest height adjusting means | |
| 16: lumbar supporting plate | 17: fixing bracket |
| 18: rack and pinion means | |
| 19: backrest fixing guide bracket | |
| 20: backrest height fixing means | |
| 141: backrest rack | 161: plate rack |
| 171: fixing axis | 181: big pinion |
| 182: small pinion | |
| (a): lumbar support | (b): thoracic support |
| (c): cervical support | |

BEST MODE

Mode for Invention

Hereinafter, exemplary embodiments of the present invention will be described in detail with reference to the accompanying drawings.

Figure 2:
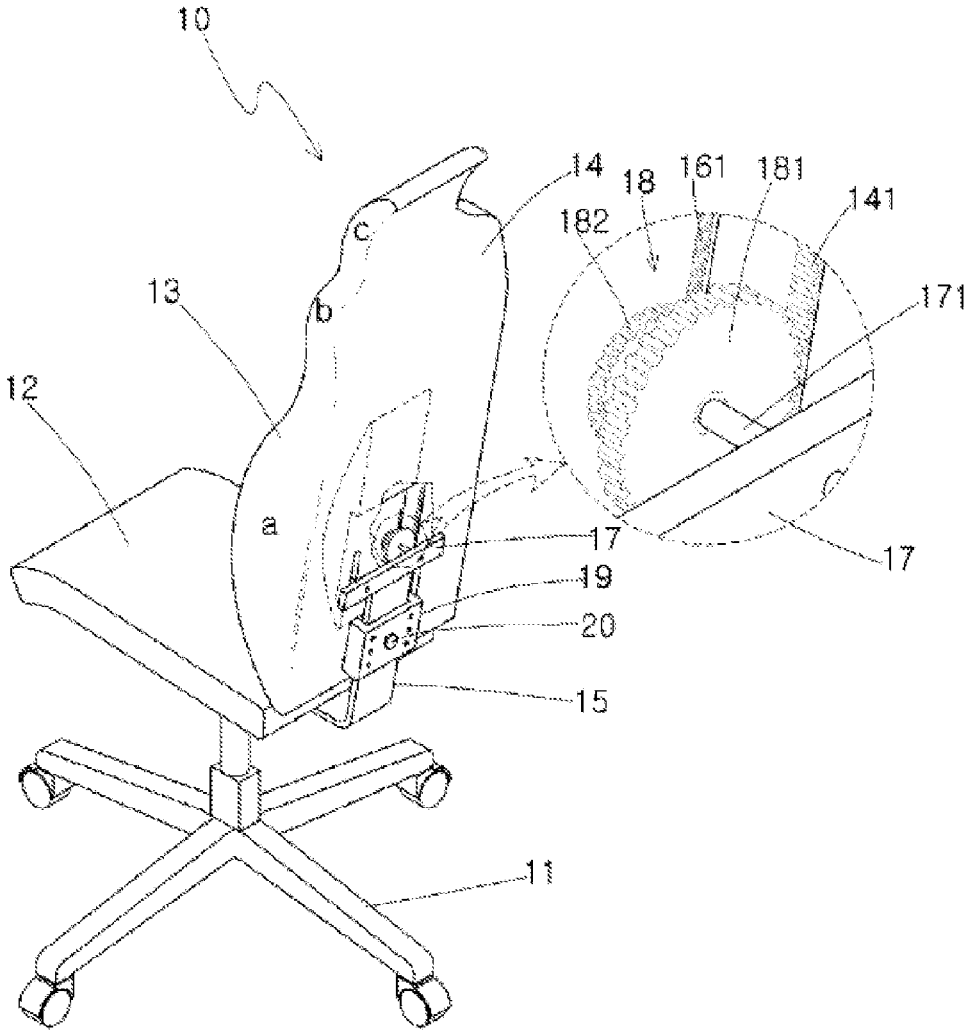
FIG. 2 is a partially perspective view illustrating a chair having an adjustable backrest for spinal protection according to the present invention.
Figure 3:
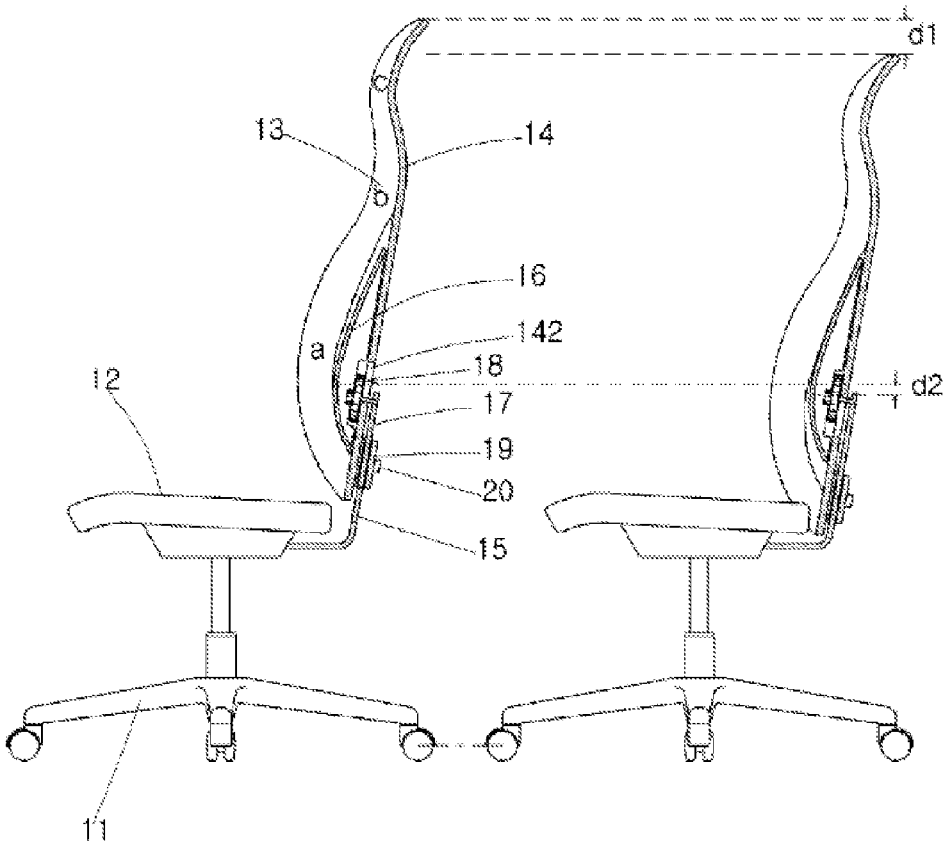
FIG. 3 is a side sectional view illustrating before and after operating a chair having an adjustable backrest for spinal protection according to the present invention.
Figure 4:
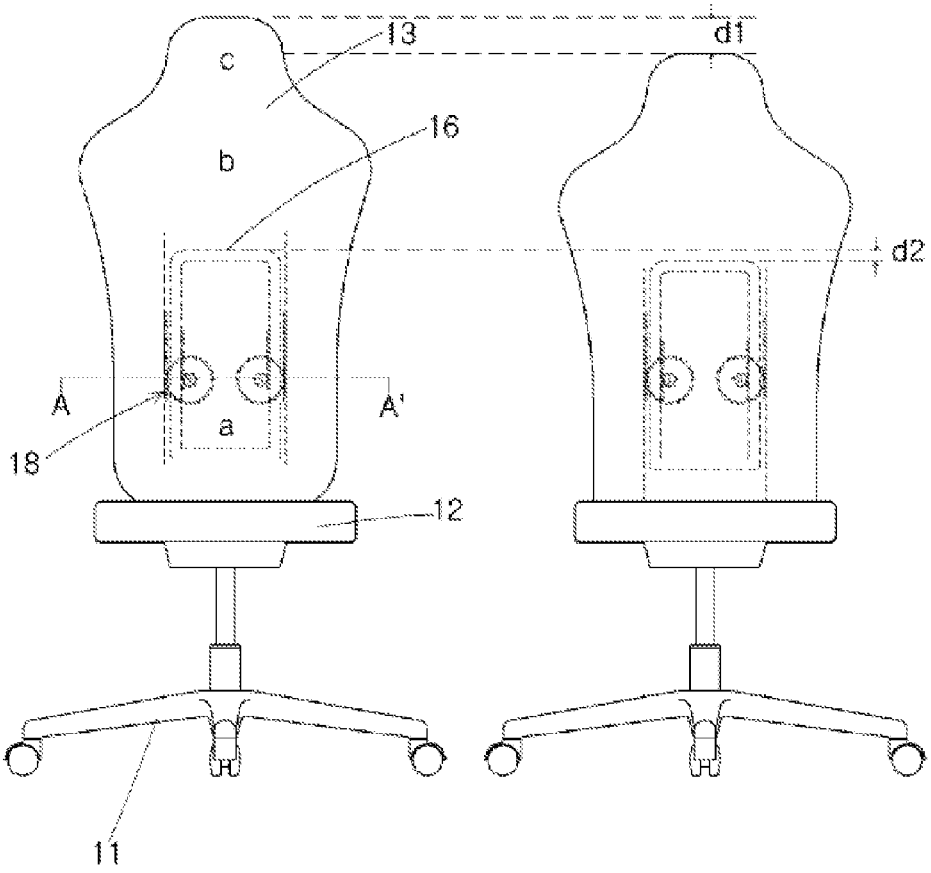
FIG. 4 is a schematically front sectional view illustrating before and after operating a chair having an adjustable backrest for spinal protection according to the present invention.
Figure 5:
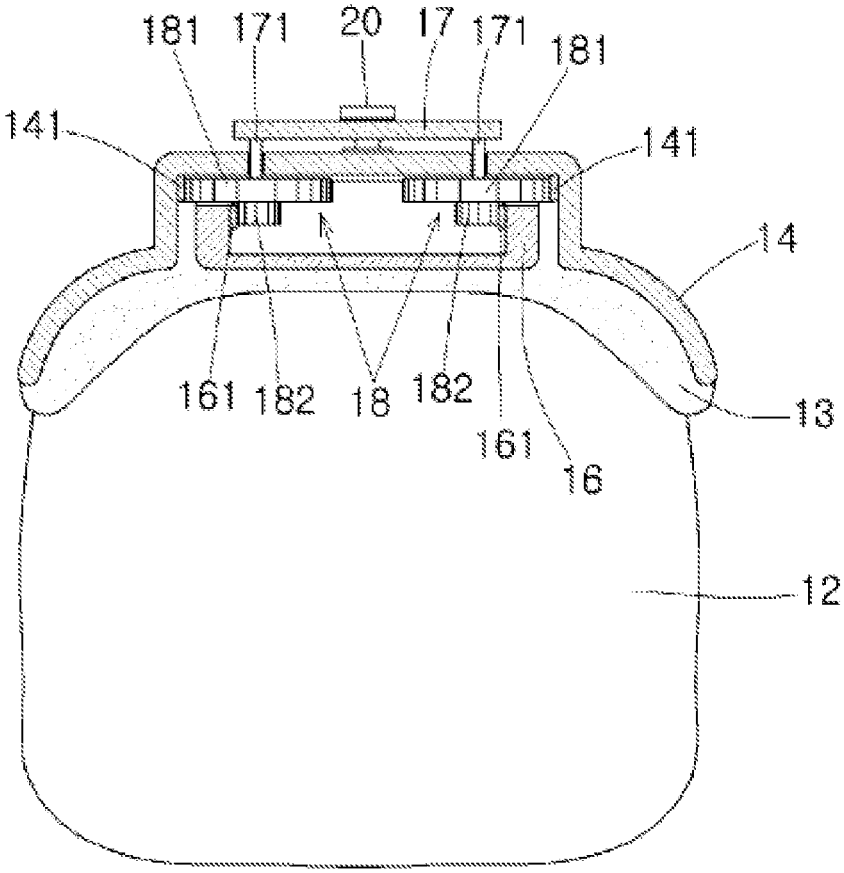
FIG. 5 is a sectional view illustrating a "A-A" line of FIG. 4.
Figure 6:
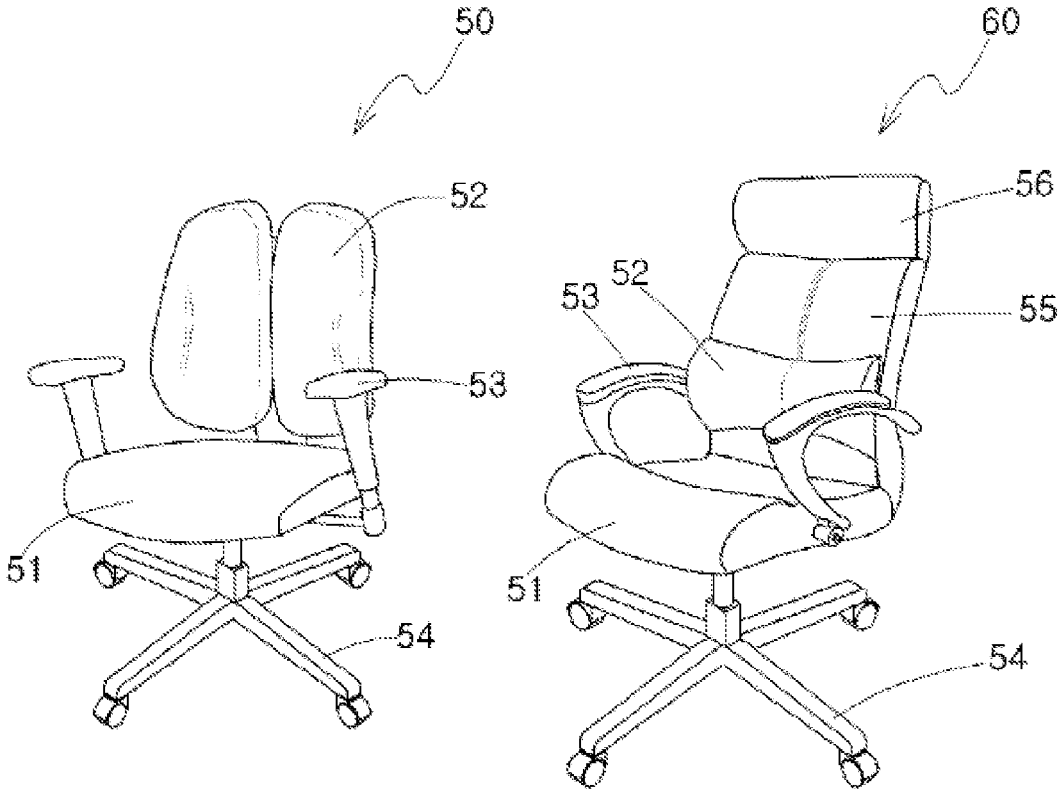
FIG. 6 Prior Art
FIG. 6 is a perspective view illustrating a conventional chair.

FIG. 1 is a perspective view illustrating a chair having an adjustable backrest for spinal protection according to the present invention, FIG. 2 is a partially perspective view illustrating a chair having an adjustable backrest for spinal protection according to the present invention, FIG. 3 is a side sectional view illustrating before and after operating a chair having an adjustable backrest for spinal protection according to the present invention, FIG. 4 is a schematically front sectional view illustrating before and after operating a chair having an adjustable backrest for spinal protection according to the present invention, FIG. 5 is a sectional view illustrating a "A-A" line of FIG. 4, and FIG. 6 is a perspective view illustrating a conventional chair.

The chair 10 having the adjustable backrest for spinal protection according to the present invention having a seat plate part 12 with a plurality of supporting legs 11 capable of sitting a user thereon, a cushion part 13 with a lumbar support (a), a thoracic support (b), and a cervical support (c) formed directly on back surface of the seat plate part 12 and that supports and protects a spine including lumbar, thoracic, and cervical vertebras of a user at the back thereof, and a backrest 14 for fixing and supporting the cushion part 13 thereto includes: a backrest height adjusting means 15 for elastically coupling the backrest 14 to the seat plate part 12 and adjusting the height of the backrest 14, a lumbar supporting plate 16 formed between the cushion part 13 and the backrest 14 and that supports flexibly the lumbar vertebra, whose position is changed according to sitting heights of the users, a rack and pinion means 18 connected and fixed to a fixing bracket 17, which is formed at an end portion of the backrest height adjusting means 15 and that allows the backrest 14 and lumbar supporting plate 16 to slides vertically so as to control flexibly the height thereof, and a backrest fixing guide bracket 19 formed at an lower end portion of the backrest 14 so as to fix the backrest 14 thereto and that inserts the backrest height adjusting means 15 therein so as to slide vertically the backrest height adjusting means 15.

One end of the backrest height adjusting means 15 is fixed to the seat plate part 12 and another end of the backrest height adjusting means 15 is fixed to the fixing bracket 17 for connecting and fixing the rack and pinion means 18 thereto. Also, the backrest height adjusting means 15 is inserted into the backrest fixing guide bracket 19 to allow the backrest height adjusting means 15 to slide vertically and go up and down the backrest 14, thereby flexibly controlling the height thereof.

Also, the backrest height adjusting means 15 includes a backrest height fixing means 20 for fixing a position of the height thereof, after the control of the height thereof is performed in such a manner that the backrest height adjusting means 15 is slid vertically in the backrest fixing guide bracket 19 and the backrest 14 is ascent and descent.

The rack and pinion means 18 includes a big pinion 181 and a small pinion 182 formed in contiguity with each other so as to be rotated to a fixing axis 171 of the fixing bracket 17 and the backrest 14 includes a backrest rack 141 interlocked with the big pinion 181 so as to linearly and vertically move the backrest 14. Also, the lumbar supporting plate 16 includes a plate rack 161 formed at an inside thereof and interlocked with the small pinion 182 so as to linearly and vertically move the lumbar supporting plate 16.

Also, the backrest 14 includes a slot groove 142 for vertically sliding and guiding the fixing axis 171.

Here, a pair of the rack and pinion means 18 are formed at both ends of the fixing bracket 17.

The lumbar supporting plate 16 includes a center portion located at a front surface portion thereof, which is in the form of a concave rounded-shape in comparison with upper and lower end portions thereof. Accordingly, it can effectively support the lumbar of the user. Also, the plate rack 161, which is interlocked with the tooth of the small pinion 182, is formed at a back surface of the lumbar supporting plate 16.

Also, since the gear ratio of the big pinion 181 and the small pinion 182 of the rack and pinion means 18 is 10:3, the expansion length of the height of the backrest rack 141 and the plate rack 161 is controlled at the rate of 10:3. This takes into account a characteristic changed between about 10:2.510:3.5 in terms of the expansion rate of the height of the cervical vertebral and the lumbar vertebral according to sitting heights of the users.

For example, where a first user sits in his chair, if his sitting height is 74 cm to the cervical vertebral and 24 cm to the lumbar vertebral, the backrest 14 and the lumbar supporting plate 16 are fixed in accordance with it. Again, where a second user sits in the same chair, if his sitting height is 64 cm to the cervical vertebral and 21 cm to the lumbar vertebral, the second user is 10 cm lower than the first user from 74 cm to 64 cm in terms of the sitting height of the cervical vertebral and the second user is 3 cm lower than the first user from 24 cm to 21 cm in terms of the sitting height of the lumbar vertebral. Accordingly, as shown in FIG. 4, the ratio (d1:d2) of the sitting height thereof is 10:3. Therefore, where the second user uses the same chair as the first user, the second user sets appropriately the backrest height adjusting means 15 down to be fixed, so that the height becomes lower at the rate of 10:3, thereby matching the body type of the second user.

However, the present invention is not limited to the ratio (d1:d2) of the sitting height thereof, that 10:3.

In the chair 10 having the adjustable backrest for spinal protection according to the present invention with the above structures, the users having different sitting heights can share the same chair. That is, during sitting thereof, in order to adjust the backrest and the lumbar supporting plate 16, which is an auxiliary backrest, in accordance with the sitting height of each user, firstly, the backrest height fixing means 20 is released from the fixing position thereof and then, it manually goes up or down the backrest 14 along the backrest fixing guide bracket 19.

Then, in a state that the big pinion 181 and the small pinion 182, which are formed at the rack and pinion means 18, are interlocked with the backrest rack 141 and the plate rack 161 respectively, they are rotated on the fixing axis 171, thereby the height positions of the backrest 14 and the lumbar supporting plate 16 can be changed simultaneously. In this case, the fixing axis 171 is vertically slid in the slot groove 142.

Here, the cervical support (c) for supporting the cervical vertebral of the user can be vertically adjusted within the height d1 as shown in FIG. 4*b*. Simultaneously, the lumbar support (a) for supporting the lumbar vertebral of the user can be vertically adjusted within the height d2 as shown in FIG. 4*b*. Accordingly, each user can flexibly adjust the backrest in accordance with the cervical vertebral and the lumbar vertebral thereof and then, fix the height thereof by means of the backrest height fixing means 20.

When the chair 10 having the adjustable backrest for spinal protection according to the present invention is operated on this wise, the height d1:d2 is automatically controlled at the rate of 10:3.

Therefore, regardless of whether the users having different sitting heights share the same chair or not, the sitting height of each user can be flexibly controlled as described above, thereby making it possible to provide effective protection to the spinal joints thereof.

Also, since various users having different sitting heights can share the same chair, it can solve the inconvenience in that the chairs are customized in accordance with private sitting heights, so that the persons having sitting heights of a predetermined interval can share the same chair, thereby manufacturing in bulk and improving the productivity thereof.

Although several exemplary embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A chair having an adjustable backrest for spinal protection having a seat plate part with a plurality of supporting legs capable of sitting a user thereon, a cushion part with a lumbar support (a), a thoracic support (b), and a cervical support (c) formed on back surface of the seat plate part and that supports and protects a spine including lumbar, thoracic, and cervical vertebras of a user at the back thereof, and a backrest for fixing and supporting the cushion part thereto comprising:

a backrest height adjusting means for coupling the backrest to the seat plate part and adjusting the height of the backrest;

a lumbar supporting plate formed between the cushion part and the backrest and that supports flexibly the lumbar vertebra, the position of the lumbar supporting plate being changed according to sitting heights of the users;

a rack and pinion means connected and fixed to a fixing bracket, which is formed at an end portion of the backrest height adjusting means and that allows the backrest and lumbar supporting plate to slide vertically so as to control adjustably the height thereof; and a backrest fixing guide bracket formed at a lower end portion of the backrest so as to slidably attach the backrest fixing guide bracket to the backrest height adjusting means and that inserts the backrest height adjusting means therein so as to slide vertically the backrest height adjusting means, wherein the rack and pinion means comprises a big pinion and a small pinion formed in contiguity with each other so as to be rotated to a fixing axis of the fixing bracket, the backrest comprises a backrest rack interlocked with the big pinion so as to linearly and vertically move the backrest, the lumbar supporting plate comprises a plate rack formed at an inside thereof and interlocked with the small pinion so as to linearly and vertically move the lumbar supporting plate, and the backrest comprises a slot groove for vertically sliding and guiding the fixing axis.

2. The chair having an adjustable backrest for spinal protection as recited in claim 1, wherein the lumbar supporting plate comprises a center portion located at a front surface portion thereof, which is in the form of a concave rounded-shape in comparison with upper and lower end portions thereof.

3. The chair having an adjustable backrest for spinal protection as recited in claim 1, wherein a pair of the rack and pinion means are formed at both ends of the fixing bracket.

4. The chair having an adjustable backrest for spinal protection as recited in claim 1, wherein the rack and pinion means is configured in such a manner that the expansion length of the height of the backrest rack and the plate rack is controlled at the rate of 10:3.

* * * * *